United States Patent [19]

Träubel et al.

[11] Patent Number: 4,831,075

[45] Date of Patent: May 16, 1989

[54] LEATHER TREATMENT AGENT

[75] Inventors: Harro Träubel, Leverkusen; Helmut Woynar, Dormagen; Hans-Werner Müller, Cologne, all of Fed. Rep. of Germany

[73] Assignee: Bayer Aktiengesellschaft, Leverkusen, Fed. Rep. of Germany

[21] Appl. No.: 40,915

[22] Filed: Apr. 21, 1987

[30] Foreign Application Priority Data

Apr. 26, 1986 [DE] Fed. Rep. of Germany ..... 3614280

[51] Int. Cl.[4] ..... C08L 67/02; C08L 67/06; C08L 77/06; C08L 71/02

[52] U.S. Cl. ..... 524/538; 524/539; 525/404; 525/408; 525/421; 525/430; 525/437; 525/532; 525/533; 8/941 R

[58] Field of Search ..... 525/404, 408, 437, 532, 525/533, 421, 430; 524/539, 538

[56] References Cited

U.S. PATENT DOCUMENTS

| | | | |
|---|---|---|---|
| 2,446,581 | 8/1948 | Gold | 525/437 |
| 3,862,072 | 1/1975 | Sekmakas | 524/539 |
| 4,156,665 | 5/1979 | Eschwey | 524/539 |
| 4,907,736 | 9/1975 | Barton | 524/539 |

*Primary Examiner*—Patricia Short

*Attorney, Agent, or Firm*—Sprung Horn Kramer & Woods

[57] ABSTRACT

Leather treatment agents contain a mixture of (a) 2–98% by weight of an adduct with a molecular weight of 500–50,000 of an alkylene oxide onto an aliphatic or aromatic compound containing one or more hydroxyl groups and (b) 98–2% by weight of a reaction product, containing carboxyl groups or salts thereof, with a molecular weight of 170–20,000 of an aliphatic, cycloaliphatic or aromatic compound containing at least two carboxyl groups or anhydrides thereof and an aliphatic or cycloaliphatic compound containing at least two hydroxyl and/or primary or secondary amino groups and, if appropiate, ether or tertiary amino groups.

4 Claims, No Drawings

LEATHER TREATMENT AGENT

The invention relates to leather treatment agents which contain a mixture of (a) 2–98% by weight of an adduct with a molecular weight of 500–50,000 of an alkylene oxide onto an aliphatic or aromatic compound containing one or more hydroxyl groups and (b) 98–2% by weight of a reaction product, containing carboxyl groups or salts thereof, with a molecular weight of 170–20,000 of an aliphatic, cycloaliphatic or aromatic compound containing at least two carboxyl groups or anhydrides thereof and an aliphatic or cycloaliphatic compound containing at least two hydroxyl and/or primary or secondary amino groups and, if appropriate, ether or tertiary amino groups, their use, and leather which has been obtained by treatment with these agents.

The leather treatment agents according to the invention preferably contain components (a) and (b) in a weight ratio of 95:5 to 5:95. They are employed as a solution, emulsion or dispersion, preferably as an aqueous solution. The pH value of the aqueous solutions is between 3 and 9, preferably between 5 and 8.

The total concentration of (a) and (b) in the leather treatment agents is, for example, 15–60% by weight, preferably 30–60% by weight.

The components (a) are free from amino groups and preferably have a molecular weight of 500–10,000.

Components (b) have, in particular, a molecular weight of 300–10,000.

A preferred mixture contains as component (a) an adduct of ethylene oxide and/or propylene oxide onto a compound of the formula

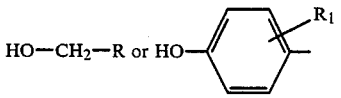

(I) (II)

wherein

R=H, stright-chain or branched $C_1$–$C_5$-alkyl which is optionally substituted by 1–5OH groups and $R_1$=H, $C_1$–$C_{12}$-alkyl or

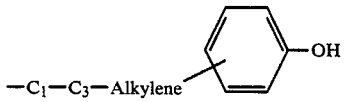

and as component (b) a reaction product of an acid of the formula

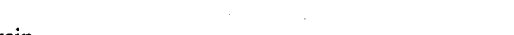

(III)

wherein

X=$C_1$–$C_8$-alkylene, —CH=CH—, cyclohexylene, or phenylene which is optionally substituted by COOH or Cl, or its anhydrides and a compound of the formula

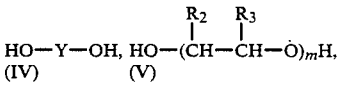

(IV) (V)

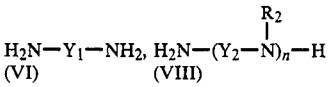

(VI) (VIII)

or

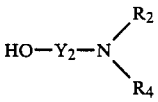

(VIII)

wherein

Y=straight-chain or branched $C_2$–$C_8$-alkylene which is optionally substituted by 1–4OH groups, or

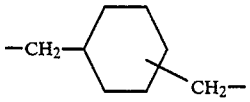

$Y_1$=$C_2$–$C_6$-alkylene, or cyclohexylene which is optionally substituted by methyl, $Y_2$=ethylene or 1,2- or 1,3-propylene, $R_2$ and $R_3$=H or $CH_3$, $R_4$=H or —$Y_2$—OH, m=3–13, in particular an average value of 8, and n=2, 3 or 4.

A particularly preferred mixture contains as component (a) an alcohol of the formula (I) and as component (b) a reaction product of maleic acid or phthalic acid or anhydrides thereof and an alcohol of the formula (V).

The components (a) are prepared by addition of ethylene oxide and/or propylene oxide onto suitable starters. Examples of such starting components with hydroxyl groups which can be employed are: water; monoalcohols, such as methanol, ethanol and butanol; diols, such as ethylene glycol, 1,2-propanediol, 1,3-propanediol, 1,4-butanediol, 1,6-hexanediol, 1,4- and 3,6-dianhydrosorbitol and 4,4'-dihydroxydiphenylpropane; triols, such as glycerol, trimethylolethane and trimethylolpropane; higher polyols, such as pentaerythritol, sorbitol, mannitol, formitol, formose and sucrose; and phenol and alkylphenols, such as nonylphenol.

Those compounds (a) which are water-soluble to the extent of more than 1 g/l at 20° C. are preferred.

Components (b) are obtained by reacting polybasic carboxylic acids with polyalcohols, polyamines and amino alcohols to give oligo-ester-amide carboxylic acids. The carboxylic acids can be employed in the form of their anhydrides.

Examples which may be mentioned of carboxylic acids are: succinic acid, adipic acid, suberic acid, azeleic acid, sebacic acid, phthalic acid, tetrahydrophthalic acid, hexahydrophthalic acid, isophthalic acid, terephthalic acid, tetrachlorophthalic acid, glutaric acid, maleic acid and fumaric acid.

Examples which may be mentioned of polyalcohols are: ethylene glycol, 1,2-propanediol, 1,3-propanediol, 1,4-butanediol, 2,3-butanediol, 1,6-hexanediol, 1,8-octanediol, neopentylglycol, 1,4-bis-[hydroxymethyl]- cyclohexane, 2-methyl-1,3-propanediol, glycerol, trimethylolpropane, 1,2,6-hexanetriol, 1,2,4-butanetriol, trimethylolethane, pentaerythritol, quinitol, mannitol, sorbitol, formitol and methylglycosides, and furthermore, in particular, oligoethylene glycols and oligopropylene glycols.

Examples which may be mentioned of polyamines are: ethylenediamine, 1,2-propylenediamine, 1,3-propylenediamine, 1,6-hexamethylenediamine, 1-amino-3-aminomethyl-3,5,5-trimethylcyclohexane, 1,4-diaminocyclohexane, diethylenetriamine, triethylenetetramine, dipropylenetriamine and tripropylenetetramine.

Examples which may be mentioned of amino alcohols are: ethanolamine, diethanolamine, N-methyl-ethanolamine, N-methyl-diethanolamine, isopropanolamine, diisopropanolamine, N-methylisopropanolamine and N-methyldiisopropanolamine.

In dyeing leather, there is frequently the problem that the dyestuff does not penetrate sufficiently deeply into the inside of the leather in the time available. An aid here can comprise carrying out the dyeing in the presence of aqueous ammonia at pH values of up to 9. However, there are limits on the dyeing of leather with ammonia as the penetration auxiliary. Ammonia very readily escapes at the temperatures of more than 40° C. customary in the dyeing, can lead to difficulties during later acidification and can lead to the fat-liquoring agents or retanning substances present to be extracted again from the leather.

On the other hand, cationic auxiliaries are described in the literature (G. Otto, "Das Farben des Leders" ("Dyeing Leather"), Darmstadt 1962). These are either long-chain quaternary ammonium salts or condensates of fatty acids with triethanolamine. Ethylene oxide adducts onto fatty acid amides, fatty acids or fatty acid alcohols are also employed as levelling auxiliaries in the dyeing (G. Otto, page 94).

German Auslegeschrift No. 2,856,628 describes ethylene oxide adducts onto alkylamines with 8–20 C atoms as levelling agents and penetration auxiliaries for dyestuffs.

German Auslegeschrift No. 2,539,671 likewise shows that $C_{4-22}$-alkylamines with hydroxyethyl end groups level dyeings. An alkylamine with preferably more than 12 C atoms in the alkyl group and with hydroxyethyl groups is described as a dyeing auxiliary in British Patent Specification No. 705,335.

Nonionic addition products of ethylene oxide are described, together with ethoxylated $C_{10-22}$-fatty amines, as surface-active dyeing auxiliaries for substrates containing nitrogen, such as, for example, leather, in U.S. Pat. No. 3,334,960.

All these products are distinguished by a frequently considerable surface-active effect, which on the one hand, by reduction of the agglomeration action of the dyestuffs, ensures an improved colour yield thereof, but on the other hand is responsible for undesirable foam being formed during dyeing, which causes spots on the leather surface on drying. The dyestuffs are stabilized in the aqueous liquor by the presence of the cationic groups and the simultaneous surface activity. The dyestuffs are therefore extracted less readily from the dye liquor, in spite of high acidification.

Surprisingly, it has not been found that the mixtures according to the invention do not show these disadvantages. They effect deep penetration of the dyestuff into the leather and, at the same time, a good depth of colour on the surface and an excellent exhaustion of the dye liquor.

The process for the treatment of leather with the new mixtures is carried out in tanning vats or tanning mixers by known methods. The temperatures are, in general, 10°–90° C., preferably 30°–60° C. The aqueous treatment liquors contain a total of 0.01–20% by weight, preferably 0.2–2% by weight (based on the shaved weight) of the agents according to the invention.

The treatment can be carried out before or at the same time as dyeing, and also together with fat-liquoring.

The products according to the invention are preferably employed together with the dyestuff in solution.

Suitable dyestuffs are the dyestuffs customary for dyeing leather, which are described, for example, in the Colour Index, vol. 2, 3rd edition.

The amount of dyestuff absorbed onto the leather and the amount of dyestuff in the residual liquor is determined optically in the following examples by the test described by H. Traubel and A. Goffin in "Leder und Hautemarkt, September 1985" ("Leather and Hide Market, September 1985") (called "test A" below).

1. Preparation of components (a)

Alkylene oxide adducts are prepared in a known manner by addition of oxiranes onto starter alcoholates and subsequent neutralization, filtration of salts and, if appropriate, addition of oxidation inhibitors.

Product 1.1.

50 parts of a polyether-alcohol based on butanol and ethylene oxide/propylene oxide in a molar ratio of 1:1, predominantly containing hydroxyethyl end groups, with an average molecular weight of 2,240 are dissolved in 50 parts of water, with stirring.

Product 1.2.

50 parts of a polyether-alcohol based on butanol and ethylene oxide/propylene oxide in a molar ratio of 1:1, predominantly containing hydroxyethyl end groups, with an average molecular weight of 1,870 are dissolved in 50 parts of water, with stirring.

Product 1.3.

50 parts of a polyether-alcohol based on butanol and ethylene oxide/propylene oxide in a molar ratio of 1:1, predominantly containing hydroxyethyl end groups, with an average molecular weight of 1,400 are dissolved in 50 parts of water, with stirring.

Product 1.4.

50 parts of a polyether-triol based on glycerol and ethylene oxide/propylene oxide in a molar ratio of 1:1, predominantly containing hydroxyethyl end groups, with an average molecular weight of 4,670 are dissolved in 50 parts of water, with stirring.

Product 1.5.

50 parts of a polyether-polyol based on sorbitol and ethylene oxide/propylene oxide in a molar ratio of 9:1, predominantly containing hydroxyethyl end groups, with an average molecular weight of 4,800 are dissolved in 50 parts of water, with stirring.

2. Preparation of components (b)

Product 2.1.

576 parts of trimellitic anhydride are melted at 180° C. 268 parts of dipropylene glycol are added dropwise in the course of 2 hours. 54 parts of water are then distilled off under a waterpump vacuum until the acid number of the product is 288 mg of KOH/g. After cooling to 100° C., the product is dissolved in a mixture of 618 parts of water and 260 parts of 25% strength ammonia.

Product 2.2.

392 parts of maleic anhydride are melted at 160° C. 740 parts of an oligoethylene glycol with a number-average molecular weight of 370 are added dropwise in the course of 2 hours. The mixture is stirred for a further 2 hours until the acid number is 203. After cooling to 100° C., the product is dissolved in a mixture of 996 parts of water and 272 parts of 25% strength ammonia to give a solution with a solids content of 50%.

Product 2.3.

592 parts of phthalic anhydride are melted at 140° C. 740 parts of the oligoethylene glycol as in Example 2.2. are added dropwise in the course of 2 hours. The mixture is stirred for a further 2 hours until the acid number is 171. After cooling to 100° C., the product is dissolved in a mixture of 1,196 parts of water and 272 parts of 25% strength ammonia to give a solution with a solids content of 50%.

Product 2.4.

924 parts of hexahydrophthalic anhydride and 438 parts of 2,2,4-trimethylpentane-1,3-diol are reacted analogously to 2.1. at 180° C. until the acid number is 247 mg of KOH/g, and the product is dissolved in a mixture of 768 parts of water and 269.5 parts of 25% strength ammonia.

Product 2.5.

800 parts of succinic anhydride and 417 parts of neopentylglycol are reacted analogously to 2.4. at 120° C. until the acid number is 373, and the product is dissolved in a mixture of 941 parts of water and 550 parts of 25% strength ammonia.

Product 2.6.

500 parts of glutaric anhydride are taken at 140° C. and 372.5 parts of 1-amino-3-aminomethyl-3,5,5-trimethylcyclohexane are added dropwise in the course of 2 hours, with stirring. The highly viscous product is stirred at 140° C. for a further 3 hours until an acid number of 282 is reached. After cooling, a solution with a solids content of 50% is established by addition of a mixture of 375 parts of water and 153.6 parts of ammonia.

3. Preparation of the mixtures according to the invention

These are obtained by mixing components (a) and (b). Specifically, the composition 3.1.–3.9 listed in Table 1 were prepared and tested.

TABLE 1

| Composition | Component a Product No. | Parts by weight | Component b Product No. | Parts by weight | Solids content Parts by weight | pH |
|---|---|---|---|---|---|---|
| 3.1. | 1.2. | 10 | 2.1. | 90 | 50 | 7.2 |
| 3.2. | 1.4. | 20 | 2.6. | 80 | 50 | 7.5 |
| 3.3. | 1.1. | 50 | 2.3. | 50 | 50 | 6.7 |
| 3.4. | 1.2. | 25 | 2.4. | 75 | 50 | 7.0 |
| 3.5. | 1.1. | 20 | 2.5. | 80 | 50 | 6.5 |
| 3.6. | 1.5 | 90 | 2.2. | 10 | 50 | 6.3 |
| 3.7. | 1.4. | 90 | 2.3. | 10 | 50 | 7.0 |
| 3.8. | 1.3. | 75 | 2.2. | 25 | 50 | 7.0 |
| 3.9. | 1.2. | 75 | 2.2 | 25 | 50 | 7.5 |

4. Use examples

Chrome-tanned leather (4.0% of $Cr_2O_3$, based on 14% of water) is divided and further processed in various ways (percentage data relate to the shaved weight).

Method A

The leather is washed, neutralized, retanned and dyed in accordance with the following recipe:

| | | |
|---|---|---|
| Washing: | 300% of water, 40° C. | 10 minutes |
| Neutralization: | 200% of water, 40° C. | 45 minutes |
| | 0.4% of calcium formate | |
| | 0.3% of sodium bicarbonate | |
| | pH 4.7–5.0, rinsing at 40° | |
| Retanning: | 200% of water, 40° | 40 minutes |
| | 2% of ® TANIGAN OS | |
| | 2% of ® RETINGAN R7 | |
| | 2% of Mimosa | |
| | pH 4.7–5.0 | |

For dyeing, the liquor is drained off after retanning and 300% of water at 50° C. and 0.5% of the mixtures 3.1–3.9 according to the invention are added. After 15 minutes, 1.5% of Direct Brown 80 (C.I. 20210) and 3% of fat-liquor mixture (1) are added. After an elapsed time of 40 minutes, the dyestuff is fixed by treatment with 1% of 85% strength formic acid (pH 4–4.5) for 20 minutes.

(1)=mixture of
60 parts of natural and synthetic fatty acids,
30 parts of unbranched chlorinated hydrocarbons and
10 parts of synthetic neatsfoot oil.

The leather is finished in the customary manner. It has a satisfactory strength of surface dyeing and a good depth of penetration of the dyestuff.

Method B

Washing, neutralization and retanning are carried out as for method A. Dyeing is carried out as follows.

1.8% of the mixtures 3.1.–3.9. according to the invention and 1.5% of the dyestuff Direct Brown 80 (=C.I. 20210) are added to the liquor (300%, 50° C.) in immediate succession in any desired sequence. The elapsed time is 40 minutes. Fat-liquoring and acidification are carried out as for method A.

Leather with a good to very good depth of colour and a good depth of penetration of the dyestuff is likewise achieved.

Method C

After washing and neutralization analogously to method A, the leather is treated, without retanning, first with 0.8% of mixture 3.3. or 3.6. according to the invention for 15 minutes (300% of water, 50° C.). Dyeing is then carried out with 1% of C.I. Acid Black 173 (40 minutes). Fat-liquoring, fixing of the dyestuff and finishing are carried out as for method A (Table 2).

Instead of C.I. Acid Black 173, it is also possible to employ C.I. Acid Red 279 and C.I. Acid Brown 429.

Method D

The leather is treated as in method C, but a retanning as in method A is carried out between the neutralization and dyeing.

Method E

Wet blue leather is treated as follows.

| | | |
|---|---|---|
| Washing: | as method A | |
| Retanning: | 200% of water | 40 minutes |
| | 4% of ® LEVOTAN K | |
| | rinsing at 40° | 5 minutes |
| Neutralization: | 200% of water | 45 minutes |
| | 0.3% of sodium bicarbonate | |
| | 0.4% of calcium formate | |
| | rinsing at 40° | 5 minutes |
| Retanning: | 200% of water, 40° C. | 45 minutes |
| | 2% of ® BAYTIGAN AR | |

-continued

| | |
|---|---|
| | 2% of ® LEVOTAN C |
| | rinsing at 40° |

The treatment with the agent 3.3. or 3.6. and the dyeing are carried out as described in method C.

Method F

The leather is washed, neutralized and dyed as in method C, but either 1% of C.I. Acid Red 279 (Table 3) or 1% of C.I. Acid Brown 429 (Table 4) is used.

A chrome extract is prepared as in method C.

Method G

The leather is washed, neutralized and retanned as in method D and dyed as in method F. The chrome extract is then prepared.

Method H

Washing, retanning, neutralization and retanning are carried out analogously to method E and dyeing is carried out analogously to method F. The chrome extract is again subsequently prepared.

The amounts of the agent 3.3. stated in Tables 3 and 4 are employed in methods F-H.

The depth of colour on the leather obtained by methods C-H and the amounts of dyestuff in the residual liquor are determined by "test A" and are given in Tables 2–4. To evaluate the depth of penetration of the dyestuff, the leather is cut at an angle of 10°–20° C. to the surface and the penetration properties are evaluated visually by comparison.

TABLE 2

| | Method | Auxiliary | Depth of colour of the dyeing (%)* | Depth of colour of the chrome extract (%) | Penetration depth of the dyestuff |
|---|---|---|---|---|---|
| Example 1 | C | 3.3. | 103 | 3 | moderate |
| Example 2 | C | 3.6. | 117 | 3 | moderate |
| Comparison Example 1 | C | none | 100 | 3 | poor |
| Example 3 | D | 3.3. | 20 | 11 | good |
| Example 4 | D | 3.6. | 28 | 7 | good |
| Comparison Example 2 | D | none | 19 | 5 | moderate |
| Example 5 | E | 3.3. | 52 | 3 | good |
| Example 6 | E | 3.6. | 47 | 3 | good |
| Comparison Example 3 | E | none | 54 | 3 | moderate |

*based on Comparison Example 1 = 100%

TABLE 3

| | Method | % by weight 3.3. | Depth of colour of the dyeing (%)* | Depth of colour of the chrome extract (%) | Penetration depth of the dyestuff |
|---|---|---|---|---|---|
| Example 7 | F | 0.5 | 93 | 5 | moderate |
| Example 8 | F | 1.0 | 100 | 4 | fairly good |
| Example 9 | F | 5.0 | 101 | 5 | fairly good |
| Example 10 | G | 0.5 | 77 | 7 | good |
| Example 11 | G | 1.0 | 81 | 10 | good |
| Example 12 | G | 5.0 | 93 | 16 | moderate |
| Example 13 | H | 0.5 | 62 | 3 | very good |
| Example 14 | H | 54 | 13 | good | |

*based on Example 8 = 100%

TABLE 4

| | Method | % by weight 3.3. | Depth of colour of the dyeing (%)* | Depth of colour of the chrome extract (%) | Penetration depth of the dyestuff |
|---|---|---|---|---|---|
| Example 15 | F | 0.5 | 100 | 3 | moderate |

TABLE 4-continued

| | Method | % by weight 3.3. | Depth of colour of the dyeing (%)* | Depth of colour of the chrome extract (%) | Penetration depth of the dyestuff |
|---|---|---|---|---|---|
| Example 16 | F | 0.75 | 112 | 3 | moderate |
| Example 17 | F | 1.0 | 120 | 4 | moderate |
| Example 18 | G | 0.5 | 51 | 20 | very good |
| Example 19 | G | 0.75 | 50 | 19 | good |
| Example 20 | G | 1.0 | 49 | 17 | good |
| Example 21 | H | 0.5 | 58 | 2 | very good |
| Example 22 | H | 0.75 | 68 | 3 | good |
| Example 23 | H | 1.0 | 77 | 3 | moderate |

*based on Example 15 = 100%

We claim:

1. Leather treatment agents consisting essentially of an aqueous mixture of (a) 2–98% by weight of an adduct with a molecular weight of 500–50,000 of ethylene oxide and/or propylene oxide onto a compound of the formula

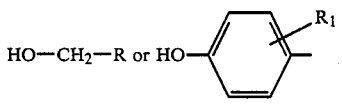

wherein

R=H, straight-chain or branched $C_1$–$C_5$-alkyl which is optionally substituted by 1–5OH groups and $R_1$=H, $C_1$–$C_{12}$-alkyl or

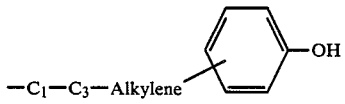

and (b) 98–2% by weight of a reaction product, containing carboxyl groups or salts thereof, with a molecular weight of 170–20,000, said products being the reaction product of a mixture consisting essentially of an acid of the formula $$HOOC—X—COOH$$

X=$C_1$–$C_8$-alkylene, —CH=CH—, cyclohexylene, or phenylene which is optionally substituted by COOH or Cl, or its anhydrides and a compound of the formula $$HO—Y—OH,\ HO—(\overset{R_2}{\overset{|}{CH}}—\overset{R_3}{\overset{|}{CH}}—O)_mH,$$

$$H_2N—Y_1—NH_2,\ H_2N—(Y_2—\overset{R_2}{\overset{|}{N}})_n—H \text{ or}$$

-continued

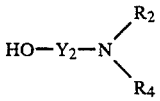

wherein

Y=straight-chain or branched $C_2$–$C_8$-alkylene which is optionally substituted by 1–4OH groups, or

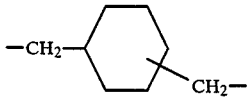

$Y_1$=$C_2$–$C_6$-alkylene, or cyclohexylene which is optionally substituted by methyl, $Y_2$=ethylene or 1,2- or 1,3-propylene, $R_2$ and $R_3$=H or $CH_3$, $R_4$=H or —$Y_2$—OH, m=3–13 and n=2, 3 or 4.

2. Leather treatment agents according to claim 1, wherein component (a) is an alcohol of the formula $$HO—CH_2—R$$

and component (b) is a reaction product of a mixture consisting essentially of maleic acid or phthalic acid or anhydrides thereof and of an alcohol of the formula $$HO—(\overset{R_2}{\overset{|}{CH}}—\overset{R_3}{\overset{|}{CH}}—O)_m—H.$$

3. Leather treatment agents according to claim 1, wherein said agents are in the form of solutions, emulsions or dispersions with a total content of (a) and (b) in said solutions, emulsions or dispersion of 15–60% by weight.

4. Leather treatment agents according to claim 1 wherein said agents are in the form of aqueous solutions with a total content of (a) and (b) in said aqueous solution of 15–60% by weight and a pH of 3–9.

* * * * *